US010190756B2

(12) United States Patent
Ford

(10) Patent No.: US 10,190,756 B2
(45) Date of Patent: Jan. 29, 2019

(54) FLEXIBLE SIGNALING DEVICE HAVING RUBBERLIKE ELONGATE DIFFUSER

(71) Applicant: 9609385 CANADA INC., Beaconsfield (CA)

(72) Inventor: Timothy D. F. Ford, Beaconsfield (CA)

(73) Assignee: 9609385 CANADA INC., Beaconsfield (CA)

( * ) Notice: Subject to any disclaimer, the term of this patent is extended or adjusted under 35 U.S.C. 154(b) by 0 days.

(21) Appl. No.: 15/422,849

(22) Filed: Feb. 2, 2017

(65) Prior Publication Data

US 2018/0216808 A1 Aug. 2, 2018

(51) Int. Cl.

| | |
|---|---|
| ***F21V 21/096*** | (2006.01) |
| ***F21V 5/00*** | (2018.01) |
| ***F21V 21/092*** | (2006.01) |
| ***F21S 9/02*** | (2006.01) |
| *F21V 23/04* | (2006.01) |
| *F21V 21/08* | (2006.01) |
| *F21L 4/02* | (2006.01) |
| *F21Y 115/10* | (2016.01) |
| *F21W 111/00* | (2006.01) |

(52) U.S. Cl.

CPC ..... *F21V 21/0965* (2013.01); *F21S 9/02* (2013.01); *F21V 5/00* (2013.01); *F21V 5/006* (2013.01); *F21V 5/008* (2013.01); *F21V 21/0925* (2013.01); *F21L 4/027* (2013.01); *F21V 21/0808* (2013.01); *F21V 23/0414* (2013.01); *F21W 2111/00* (2013.01); *F21Y 2115/10* (2016.08)

(58) Field of Classification Search

CPC ..... F21V 21/0885; F21V 21/0965; F21V 21/0925; F21V 5/006; F21L 4/027; F21Y 2115/10; F21S 4/22

See application file for complete search history.

(56) References Cited

U.S. PATENT DOCUMENTS

| | | | | |
|---|---|---|---|---|
| 4,597,033 A * | 6/1986 | Meggs | ..... | F21S 8/032 362/183 |
| 6,708,433 B1 * | 3/2004 | Falkner | ..... | B60Q 1/2615 40/552 |
| 7,604,376 B2 * | 10/2009 | Sloan | ..... | F21V 21/005 362/240 |

* cited by examiner

*Primary Examiner* — Robert J May

(74) *Attorney, Agent, or Firm* — Hugh Mansfield

(57) ABSTRACT

A flexible signalling device is disclosed comprising a housing manufactured from a rigid material and comprising a flat bottom and a rounded top, an electronic circuit positioned within the housing and comprising at least one LED arranged along a light emitting edge of the housing, a battery and a user actuatable switch for selectively energizing the at least one LED, a lens covering the at least one LED, and a solid elongate light diffuser manufactured from a non-opaque flexible rubberlike material. The housing and the light diffuser combine to form a unitary elongate ellipsoid when viewed from above and further wherein the at least one LED is arranged to emit light through the lens and into the diffuser along a length thereof.

11 Claims, 6 Drawing Sheets

FLEXIBLE SIGNALING DEVICE HAVING RUBBERLIKE ELONGATE DIFFUSER

CROSS REFERENCE TO RELATED APPLICATIONS

This application claims benefit under 35 U.S.C. § 119(e) of U.S. provisional application Ser. No. 62/290,042 filed on Feb. 2, 2016 which is incorporated herein in its entirety by reference.

FIELD OF THE INVENTION

The present invention relates to a flexible signalling device. In particular, the present invention relates to an elongate flexible signalling device which can attached to a surface having an arbitrary curvature.

BACKGROUND TO THE INVENTION

The prior art discloses lighting devices for use on curved surfaces. One drawback of these prior art devices is that they are preformed to a particular curvature and therefore cannot be used on a variety if surface of different curvatures. Another drawback is that the prior art devices are of a relatively high profile and tend to stick out from the curved surface and/or include relatively sharp edges and such that they are prone to snagging on netting or ropes and the like. This can result, for example, in the device becoming entangled in the netting or rope or being inadvertently removed from the curved surface.

SUMMARY OF THE INVENTION

In order to address the above and other drawbacks there is provided a flexible signalling device comprising a housing manufactured from a rigid material and comprising a flat bottom surface, an electronic circuit positioned within the housing and comprising at least one LED arranged along a light emitting edge of the housing, a battery and a user actuatable switch for selectively energizing the at least one LED, a lens covering the at least one LED, and a solid elongate light diffuser manufactured from a non-opaque flexible rubberlike material, wherein the housing and the light diffuser combine to form a unitary elongate quasi-ellipsoid when viewed from above and further wherein the at least one LED is arranged to emit light through the lens and into the diffuser along a length thereof.

There is also provided a method for illuminating a surface having an arbitrary curvature comprising securing a first end of a flexible signalling device comprising a solid elongate light diffuser comprising a flat bottom surface and manufactured from an illuminated non-opaque flexible rubberlike material to the surface, bending the elongate light diffuser such that the bottom surface conforms to the arbitrary curvature of the surface, and securing a second end of the flexible signalling device to the surface.

DETAILED DESCRIPTION OF THE ILLUSTRATIVE EMBODIMENTS

Figure 1:
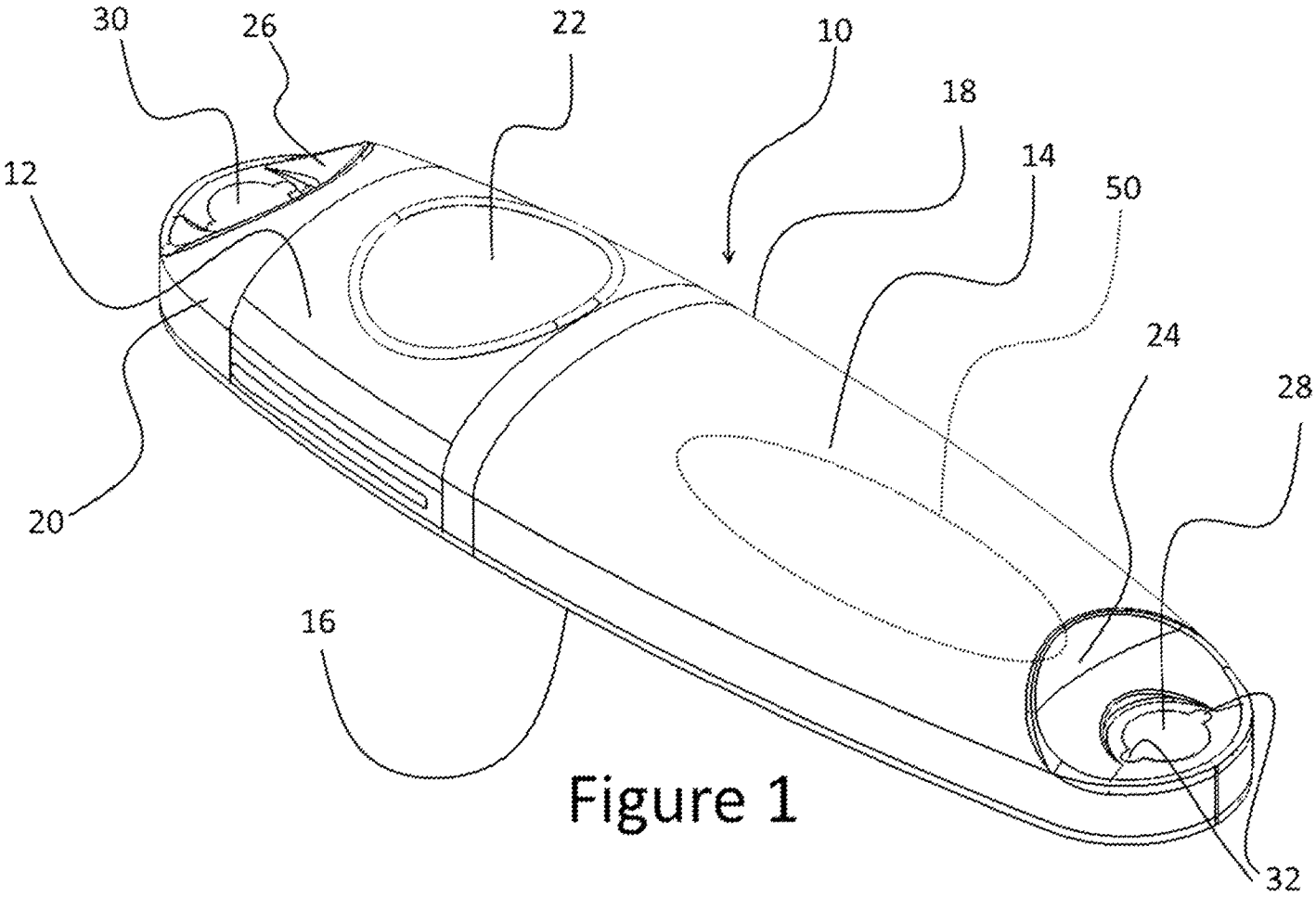
FIG. 1 provides an isometric view of a flexible signalling device in accordance with an illustrative embodiment of the present invention.

Referring now to FIG. 1, a flexible signalling device generally referred to using the reference numeral 10, and in accordance with an illustrative embodiment of the present invention will now be described. The flexible signalling device 10 comprises a housing 12 manufactured from a rigid material such as plastic or the like, an elongate light diffuser 14 manufactured from a non-opaque flexible rubberlike material such as suitable mixtures including translucent silicon or Santoprene or the like. The housing 12 and diffuser 14 combine to form a device having a flat bottom 16, a smoothly curved top 18 and a unitary elongate quasi-ellipsoid shape when viewed from above. In a particular embodiment, the short end 20 of the device 10 opposite the diffuser 14 is also manufactured from the same non-opaque flexible rubberlike material as the diffuser with the housing 12 sandwiched between the diffuser 14 and the short end 20.

Still referring to FIG. 1, as will be discussed in more detail below, the housing 12 houses an electronic circuit and comprises a push button 22 for actuating the circuit. Illustratively, the ends of the device 10 comprise indentations 24, 26 and define respective fastener receiving apertures 28, 30, for example for attaching the device 10 to a mounting plate or the like (not shown). Illustratively, the apertures 28, 30 comprise notches 32 to receive a keyed fastener, for example.

Figure 2:
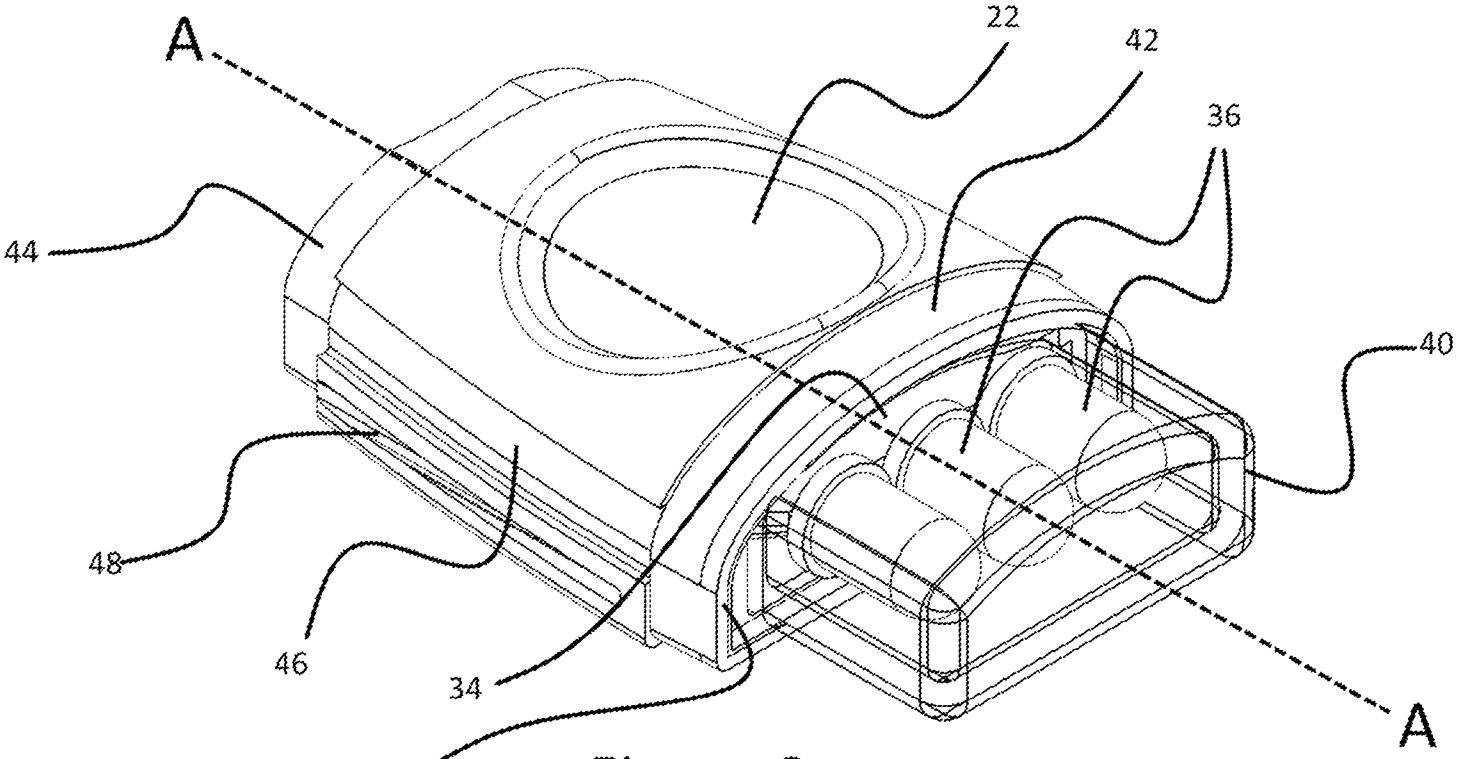
FIG. 2 provides an isometric view of a housing for a flexible signalling device in accordance with an illustrative embodiment of the present invention.

Referring now to FIG. 2, the housing 12 as discussed above houses an electronic circuit 34 comprising a plurality of LEDs 36 which are arranged along a light emitting edge 38 of the housing 12 to emit light generally in parallel to an axis A-A of the device. The LEDs 36 are covered by a non-opaque, typically transparent, lens 40. In a particular embodiment the beams of the outer LEDs 36 can be slightly angled such that all LEDs 36 they converge towards a point, for example at the extreme end of the diffuser 14. The housing further comprises collars 42, 44 onto which the diffuser 14 can be overmoulded. Additionally, a longitudinal channel 46 can be provided in the housing such that during overmoulding a bridging portion 46 of the material used to fabricate the diffuser 14 and short end 20 interconnects the diffuser 14 and short end 20, thereby simplifying moulding and improving the aesthetic appeal of the device. A cap 48 is also provided in the side of the housing to allow access to the interior of the housing, for example to change a battery (not shown) or the like. In a particular embodiment the cap 48 may be permanently attached to the housing 12, for example using and adhesive or through welding or the like, in order to seal the battery permanently within the housing 12. Alternatively, the housing 12 can be overmoulded with the same material used to fabricate the diffuser 14 and such that the battery is permanently sealed within the housing 12.

Still referring to FIG. 2, in a particular embodiment the non-opaque flexible rubberlike material used to fabricate the diffuser 14 is buoyant and such that the device 10 floats when placed in fresh or salt water. Alternatively, or additionally, the inside of the diffuser 14 may be fabricated such that a hollow chamber 50 is formed, thereby increasing buoyancy. Additionally, the sides of the diffuser 14 can be made opaque and/or silvered on the inside and such that they reflect the light emitted by the LEDs 36 inwards such that more visible light is emitted via the upper surface of the diffuser.

Figure 3A:
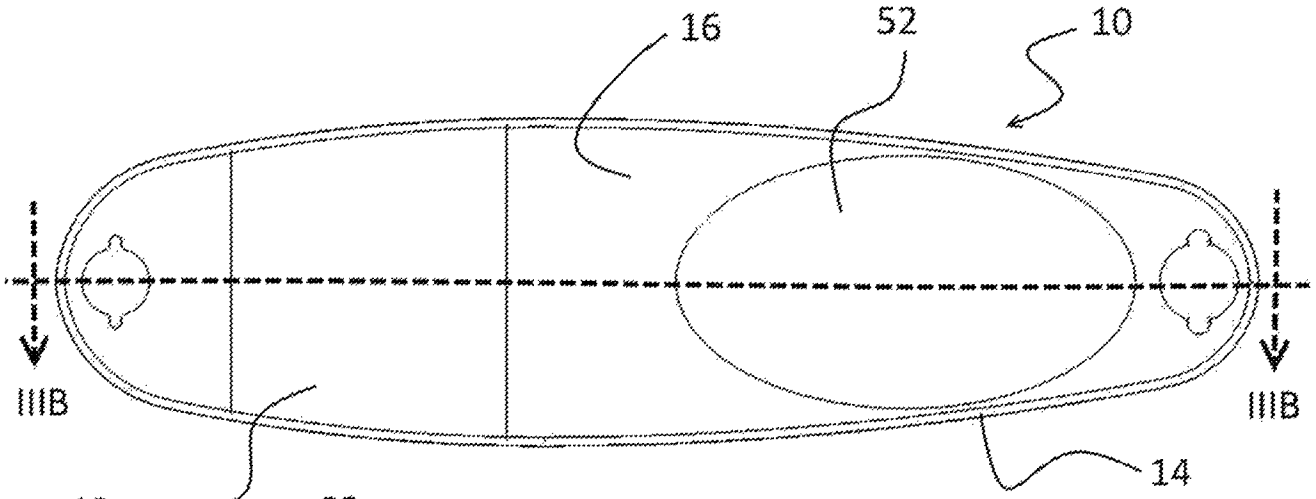
FIG. 3A provides a bottom plan view of a flexible signalling device in accordance with an illustrative embodiment of the present invention.
Figure 3B:
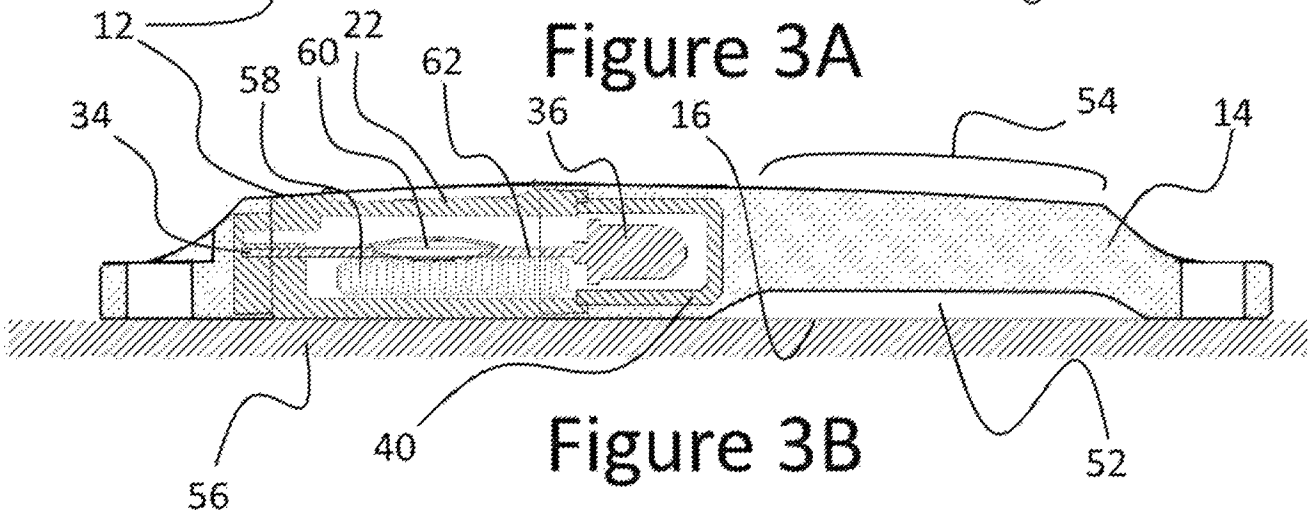
FIG. 3B provides a sectional view along the line IIIB-IIIB of the flexible signalling device in FIG. 3A.

Referring now to FIG. 3A, the device 10 further comprises a depression 52 formed in the bottom 16 of the diffuser 14. Referring to FIG. 3B in addition to FIG. 3A, by pressing against an upper surface of the diffuser 14 in a region 54 above the depression 52 while the bottom 16 of the device is pressed against a smooth surface such as glass or smooth metal or the, a suction force can be developed within the depression 52 and such that the bottom 16 is held by the auction force against the surface 56. Alternatively, or additionally, a small magnet or magnets could be imbedded in the bottom 16 of the diffuser 14, allowing the device to be easily attached to metallic surfaces or the like.

Still referring to FIG. 3B, as discussed above, the electronic circuit 34 is held within the housing 12 and comprises, for example, a battery 58, a switch 60 activated by the push button 22 and a Printed Circuit Board (PCB) 62 comprising traces interconnecting the battery 58, switch 60 and the like with the LEDs 36.

Figure 4:
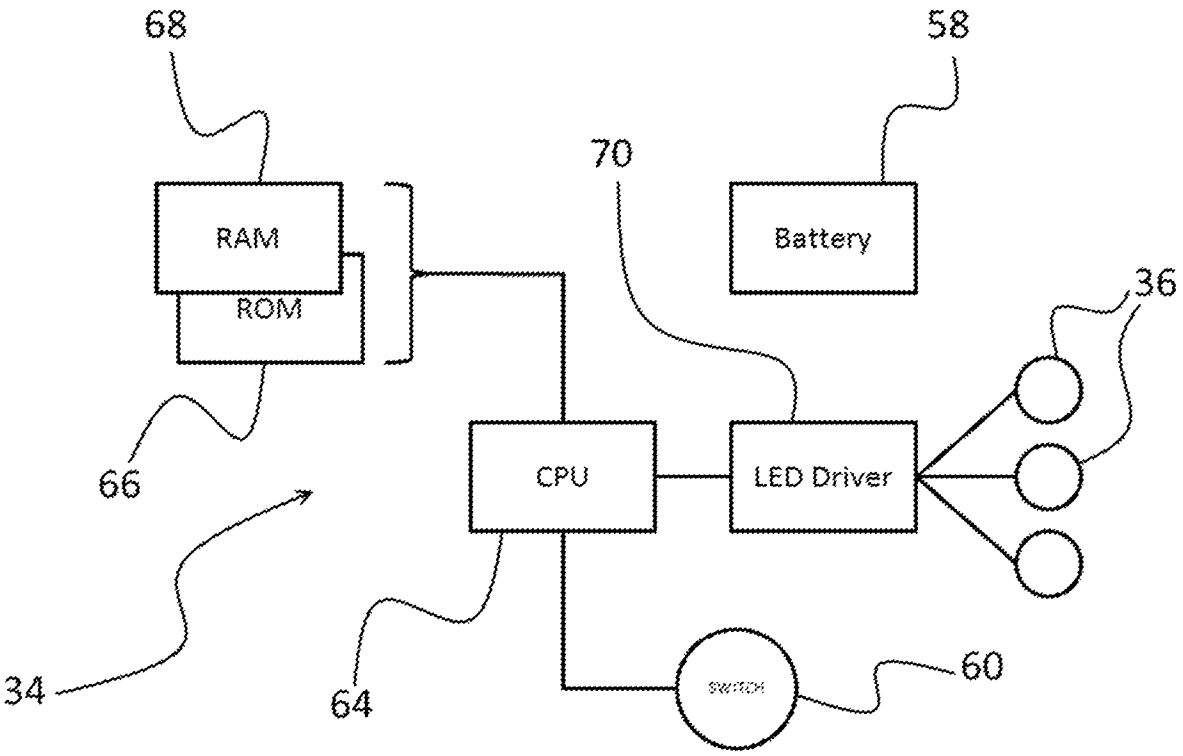
FIG. 4 provides a schematic diagram of an electronic circuit for use with a flexible signalling device and in accordance with a illustrative embodiment of the present invention.

Referring now to FIG. 4, although in an illustrative embodiment the battery 58 simply provides power to the LEDs 36 under control of the switch 60, in a particular embodiment the electronic circuit 22 comprises additional components such as a CPU 64 which controls the one or more LEDs 36 using software and data stored in ROM 66 or RAM 68 and via an LED Driver 70 to provide enhanced visual effects such as flashing or the like.

Figure 5:
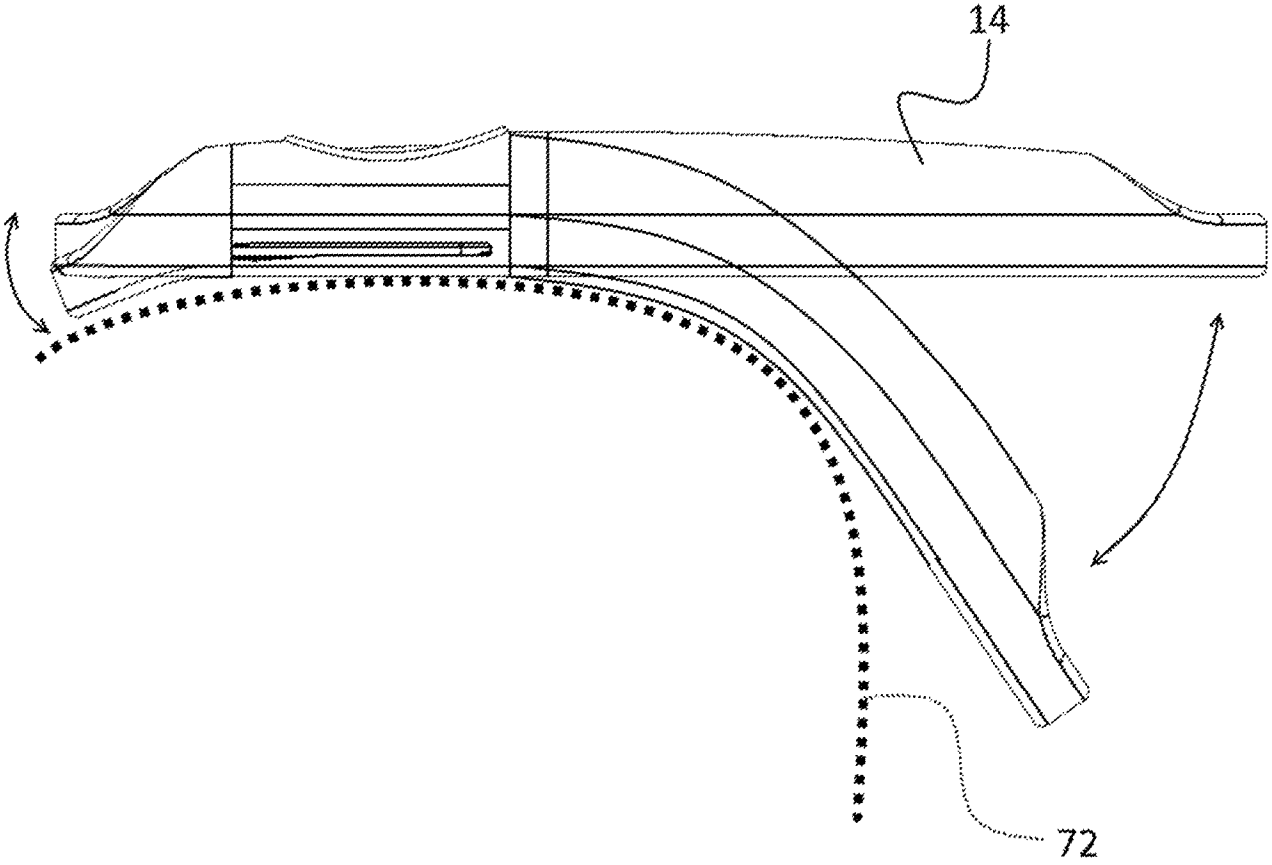
FIG. 5 provides a side plan view of a flexible signalling device in accordance with an illustrative embodiment of the present invention and detailing its flexibility.

Referring now to FIG. 5, as discussed above the diffuser 14 is flexible and such that it can form to surfaces which are not flat, for example the outer surface of a helmet 72 or the like.

Figure 6:
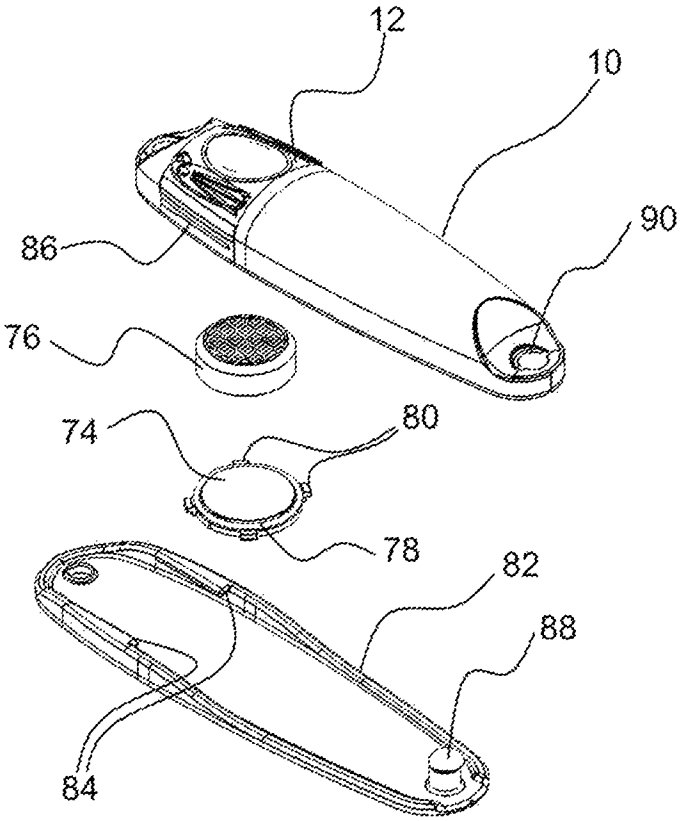
FIG. 6 provides an isometric view of a flexible signalling device in accordance with an alternative illustrative embodiment of the present invention.

Referring now to FIG. 6, in an alternative embodiment of the present invention, a cap 74 is provided to close an opening (not shown) in the bottom of the housing 12 to allow for the exchange of a battery 76 to power the circuit. The cap 74 includes an O-ring 78 to prevent the egress of moisture and dirt and the like. The cap 74 is secured to the opening by placing the cap 74 over the opening and turning such that a plurality of bosses 80 are engaged by reciprocal slot like structures (also not shown) surrounding the opening. As discussed above, in a particular embodiment the cap 74 may be permanently attached to the opening to seal the battery 76 within the housing 12, for example using an adhesive or the like. Alternatively, the battery 76 may be inserted prior to overmoulding and the housing 12 overmoulded with the same material used to fabricate the diffuser 14 and such that the battery is permanently sealed within the housing 12.

Still referring to FIG. 6, an accessory attachment 82 is also provided and to which the device 10 can be secured. The attachment 82 comprises one or more means for securing the device 10 to other objects, for example a toolless connector (not shown) such as magnet, Velcro or the like or an adhesive. The device 10 is secured to the accessory attachment 82 by aligning each of a pair guides 84 with respective ones of a pair slots 86 moulded on either side (only one shown) of the housing 12, and then sliding the guides 84 onto the slots 86 and the device 10 onto the attachment. A button post 88 on the attachment 82 is inserted into a corresponding hole 90 in the device thereby securing the device 10 to the attachment. A person of ordinary skill in the art will now understand that, although the attachment 82 might be rigid, the device 10 can be easily secured to the attachment 82 due to its flexible nature.

Although the present invention has been described hereinabove by way of specific embodiments thereof, it can be modified, without departing from the spirit and nature of the subject invention as defined in the claims.

I claim:

1. A flexible signalling device comprising:

a housing manufactured from a rigid material and comprising a flat bottom;

an electronic circuit positioned within said housing and comprising at least one LED arranged along a light emitting edge of said housing, a battery and a user actuatable switch for selectively energizing said at least one LED;

a lens covering said at least one LED; and a solid elongate light diffuser manufactured from a non-opaque flexible rubberlike material comprising a flat bottom;

wherein said housing and said light diffuser combine to form a unitary elongate quasi-ellipsoid when viewed from above and further wherein said at least one LED is arranged to emit light through said lens and into said diffuser along a length thereof.

2. The flexible signalling device of claim 1, wherein said housing and said light diffuser each comprise a rounded top.

3. The flexible signalling device of claim 1, comprising a plurality of said at least one LED arranged side by side along said light emitting edge.

4. The flexible signalling device of claim 1, wherein said diffuser is over moulded over said lens and onto said light emitting edge.

5. The flexible signalling device of claim 1, wherein said light diffuser comprises a flat bottom and a rounded top.

6. The flexible signalling device of claim 1, wherein said light diffuser comprises a flat bottom and further wherein a suction cup is moulded into said flat bottom.

7. The flexible signalling device of claim 1, wherein said non-opaque flexible rubberlike material comprises one of translucent silicon, Santoprene and combinations thereof.

8. The flexible signalling device of claim 1, comprising at least one magnet imbedded in a bottom of said diffuser.

9. The flexible signalling device of claim 1, wherein said diffuser defines an aperture at each end for receiving a fastener.

10. The flexible signalling device of claim 1, further comprising a removable flexible attachment comprising a first surface for securing to said bottom surface and a second surface comprising a securing means.

11. The flexible signalling device of claim 10, wherein said securing means comprises one of a magnet, Velcro and an adhesive.

* * * * *